US010217547B1

(12) United States Patent
Kaneda et al.

(10) Patent No.: US 10,217,547 B1
(45) Date of Patent: Feb. 26, 2019

(54) POWER CABLE

(71) Applicant: SUMITOMO ELECTRIC INDUSTRIES, LTD., Osaka (JP)

(72) Inventors: Taiki Kaneda, Osaka (JP); Shoji Mashio, Osaka (JP)

(73) Assignee: SUMITOMO ELECTRIC INDUSTRIES, LTD., Osaka (JP)

( * ) Notice: Subject to any disclaimer, the term of this patent is extended or adjusted under 35 U.S.C. 154(b) by 0 days.

(21) Appl. No.: 15/873,205

(22) Filed: Jan. 17, 2018

(30) Foreign Application Priority Data

Aug. 30, 2017 (JP) ..... 2017-165254

(51) Int. Cl.

| | |
|---|---|
| ***H01B 11/02*** | (2006.01) |
| ***H01B 9/02*** | (2006.01) |
| ***H01B 7/22*** | (2006.01) |
| ***H01B 7/20*** | (2006.01) |
| ***H01B 9/00*** | (2006.01) |

(52) U.S. Cl.
CPC ..... *H01B 9/02* (2013.01); *H01B 7/20* (2013.01); *H01B 7/225* (2013.01); *H01B 9/003* (2013.01); *H01B 11/02* (2013.01)

(58) Field of Classification Search
USPC ..... 174/72 A
See application file for complete search history.

(56) References Cited

U.S. PATENT DOCUMENTS 2,597,222 A * 5/1952 Bennett ..... H01B 9/00 174/10
2,621,703 A * 12/1952 Morrison ..... H01B 7/1875 156/51
2,981,788 A * 4/1961 Bunish ..... H01B 9/028 174/103
3,076,865 A * 2/1963 Volk ..... H02G 7/12 174/146
3,300,576 A * 1/1967 Hendrix ..... H02G 7/12 174/146

(Continued)

OTHER PUBLICATIONS

NKT Cables, "High Voltage Cable Systems, Cables and Accessories up to 550 kV", http://www.cablejoints.co.uk/upload/NKT_Cables_Extra_High_Voltate_132kV_220kV_400kV_500kV_Brochure.pdf.

(Continued)

*Primary Examiner* — William H Mayo, III
*Assistant Examiner* — Krystal Robinson
(74) *Attorney, Agent, or Firm* — IPUSA, PLLC

(57) ABSTRACT

A power cable to be provided inside a steel pipe that is electrically connected to a reference potential node, includes 3 transmission cables, 3 ground buses making contact with outer peripheral surfaces of adjacent transmission cables and arranged at 3-fold rotationally symmetrical positions with respect to a center of the transmission cables in a cross sectional view, a binder covering the ground buses and the transmission cables, and a jacket provided to overlap the binder. The transmission cables have outer diameters to inscribe a first circle having a radius corresponding to a radius of a second, envelope circle of the power cable having a maximum radius inside the steel pipe, but excluding thicknesses of the binder and the jacket. The ground buses have outer diameters to project outwardly of an envelope closed curve of the transmission cables, but less than or equal to a diameter of the first circle.

19 Claims, 5 Drawing Sheets

(56) References Cited

U.S. PATENT DOCUMENTS 3,582,983 A * 6/1971 Claren ..... H02G 7/125 174/146
3,613,104 A * 10/1971 Bradshaw ..... H02G 7/125 174/72 R
3,617,609 A * 11/1971 Tuttle ..... H02G 7/125 174/146
3,748,370 A * 7/1973 Dalia ..... H02G 7/125 174/42
3,817,783 A * 6/1974 Verne ..... H01B 3/004 156/51
4,012,581 A * 3/1977 Hawkins ..... H02G 7/125 174/146
7,166,802 B2 * 1/2007 Cusson ..... H01B 7/20 174/105 R
9,022,357 B2 * 5/2015 Argyle ..... H02G 1/06 254/134.3 PA
9,036,323 B1 * 5/2015 White ..... H02H 1/04 361/218
9,444,240 B2 * 9/2016 Argyle ..... H02G 7/12
2003/0079903 A1 * 5/2003 Scheidecker ..... H01B 3/443 174/110 F
2013/0306348 A1 * 11/2013 Holzmueller ..... H01B 9/02 174/105 R
2015/0206629 A1 * 7/2015 Ona ..... H02G 9/06 174/24
2018/0047481 A1 * 2/2018 Dalin ..... H01B 7/282

OTHER PUBLICATIONS

J. H. Neher and M. H. McGrath, "The Calculation of the Temperature Rise and Load Capability of Cable Systems", General Cable Corporation, Power Apparatus and Systems, Oct. 1957, vol. 76, Issue 3, pp. 752-764.

* cited by examiner

| | Cross Sectional Area of Ground Buses | Current Ratio $I_{ECC}/I_C$ | Heat Generation Rate of Ground Buses | Magnetic Field at Outer Surface of Steel Pipe | Iron Loss |
|---|---|---|---|---|---|
| Power Cable 1000 of Comparison Example | 0% | 0% | Times 0 | 100% | 100% |
| Power Cable 100 | 100% | 35% | Times 1 | 87% | 70% |
| Power Cable 100M | 27% | 25% | Times 1.9 | 90% | 80% |

POWER CABLE

CROSS-REFERENCE TO RELATED APPLICATIONS

This application is based upon and claims priority to Japanese Patent Application No. 2017-165254 filed on Aug. 30, 2017, the entire contents of which are incorporated herein by reference.

BACKGROUND OF THE INVENTION

1. Field of the Invention

The present invention relates to a power cable.

2. Description of the Related Art

A conventional power cable, often referred to as a POF (Pipe type Oil Filled) cable, includes 3-phase transmission cables that are wrapped by insulating paper and provided inside a steel pipe. The 3-phase transmission cables are insulated by providing an insulating oil inside the steel pipe. The POF cables are popularly used in various regions, including the U.S.A. However, the insulating oil in the POF cable may leak with aged deterioration of the steel pipe, to thereby increase maintenance costs and cause adverse effects on environment. Accordingly, there are demands to replace the POF cables by crosslinked poly-ethylene cables that do not use insulating oil.

For example, replacements for the POF cables include a power cable "CITYCABLE" (registered trademark) manufactured by NKT Cables Group GmbH. For example, the power cable "CITYCABLE" is described in "High Voltage Cable System, Cables and Accessories up to 550 kV", at the following NKT Cables URL: http://www.cablejoints.co.uk/upload/NKT_Cables_Extra_High_Voltate_132 kV_220 kV_400 kV_500 kV_Brochure.pdf.

On the other hand, in order to provide insulation in the crosslinked poly-ethylene cables, the insulating paper needs to be thicker than the insulating paper used in the POF cables. In addition, the crosslinked poly-ethylene cable requires a metal shield that covers the crosslinked poly-ethylene cable, and a corrosion-proof layer, such as a sheath made of PVC (Poly-Vinyl Chloride) or PE (Poly-Ethylene).

However, an internal diameter of the steel pipe is determined in advance. For this reason, a conductor size of the power cable needs to be reduced in order to maintain the insulating paper thickness that is required for the electrical insulation. In one example of the cross-linked poly-ethylene cable having the insulating paper thickness that is required for the electrical insulation, the conductor size is limited to 1000 $mm^2$ or less in a cross section of the conductor. In other words, there is a limit to an outer diameter of the transmission cables.

Further, in addition to the limit to the outer diameter of the transmission cables, there is a problem in that transmission capacities of the POF cables decrease due to iron loss. In a case in which the 3-phase transmission cables are arranged at 3-fold rotationally symmetrical positions within the steel pipe that is magnetic, a ratio of the iron loss of the transmission cables to a loss within the conductors may generally be obtained from the following formula (1), where $Y_s$ denotes an iron loss rate of the power cable with respect to AC (Alternating Current) conductor resistance, S denotes a correlation length (inches) of the power cable, $D_p$ denotes an internal diameter (inches) of the steel pipe, and $R_{ac}$ denotes an AC conductor resistance (μΩ/feet) of the power cable. The formula (1) is described in J. H. Neher and M. H. McGrath, "The Calculation of the Temperature Rise and Load Capability of Cable Systems", 1957, Vol. 76, Issue 3, pp. 752-764 (DOI: 10.1109/AIEEPAS. 1957.4499653 ISSN: 0097-2460), for example.

$$Y_s=\{(0.89S-0.115D_p)/R_{ac}\}\times 1.7 \quad (1)$$

In a case in which the conductors have 3500 kcmil at 345 kV and an insulating paper thickness of 1 inch, and S=4.2 inches, $D_p$=10.25 inches, and $R_{ac}$=4.00 μΩQ/feet, the iron loss rate $Y_s$ computed from the formula (1) is 0.88.

In other words, the iron loss of 88% is generated inside the steel pipe, and the transmission cables generate heat. Compared to the cross-linked poly-ethylene cable that includes no oil inside the steel pipe, the POF cable has a larger loss, is less efficient, and has a reduced current carrying capacity.

SUMMARY OF THE INVENTION

Embodiments of the present invention can provide a power cable with reduced iron loss and increased transmission power.

According to one aspect of the present invention, a power cable to be provided inside a steel pipe that is electrically connected to a reference potential node, includes three transmission cables respectively including one of three conductor wires configured to transmit 3-phase alternating current power, an insulating layer covering the three conductor wires, and a semiconductive layer covering the insulating layer, wherein the three transmission cables are arranged at three-fold rotationally symmetrical positions with respect to a center of the three transmission cables in a cross sectional view in a state in which the semiconductive layers of adjacent transmission cables of the three transmission cables make contact with each other, and wherein the cross sectional view is taken in a direction perpendicular to a longitudinal direction of the power cable; three ground buses respectively making contact with outer peripheral surfaces of two adjacent transmission cables of the three transmission cables, and arranged at three-fold rotationally symmetrical positions with respect to the center of the three transmission cables in the cross sectional view; a binder covering outer peripheral surfaces of the three ground buses and the outer peripheral surfaces of the three transmission cables; and a jacket provided on the binder to overlap the binder, wherein the three transmission cables have outer diameters so as to inscribe a first circle that has a radius in the cross sectional view corresponding to a radius of a second, envelope circle of the power cable having a maximum radius inside the steel pipe, but excluding thicknesses of the binder and the jacket, and wherein the three ground buses have outer diameters such that the three ground buses project in a radial direction from the center, outwardly of an envelope closed curve of the three transmission cables surrounding the outer peripheral surfaces of the three transmission cables in the cross sectional view, but the outer diameters of the three ground buses are less than or equal to a diameter of the first circle.

Other objects and further features of the present invention will be apparent from the following detailed description when read in conjunction with the accompanying drawings.

DESCRIPTION OF THE PREFERRED EMBODIMENTS

Figure 1A:
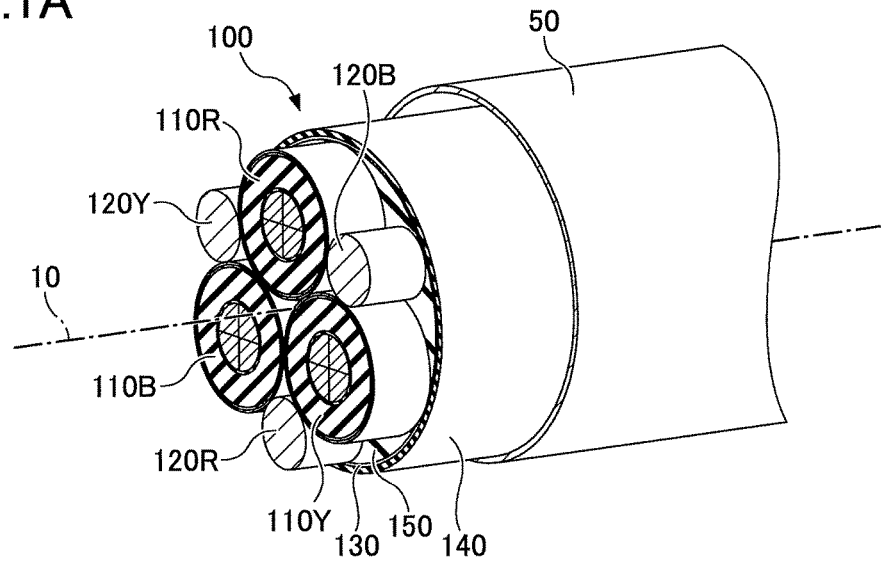
FIGS. 1A and 1B are diagrams illustrating a power cable 100 in one embodiment.

A description will be given of embodiments of a power cable according to the present invention, by referring to the drawing.

Figure 1B:
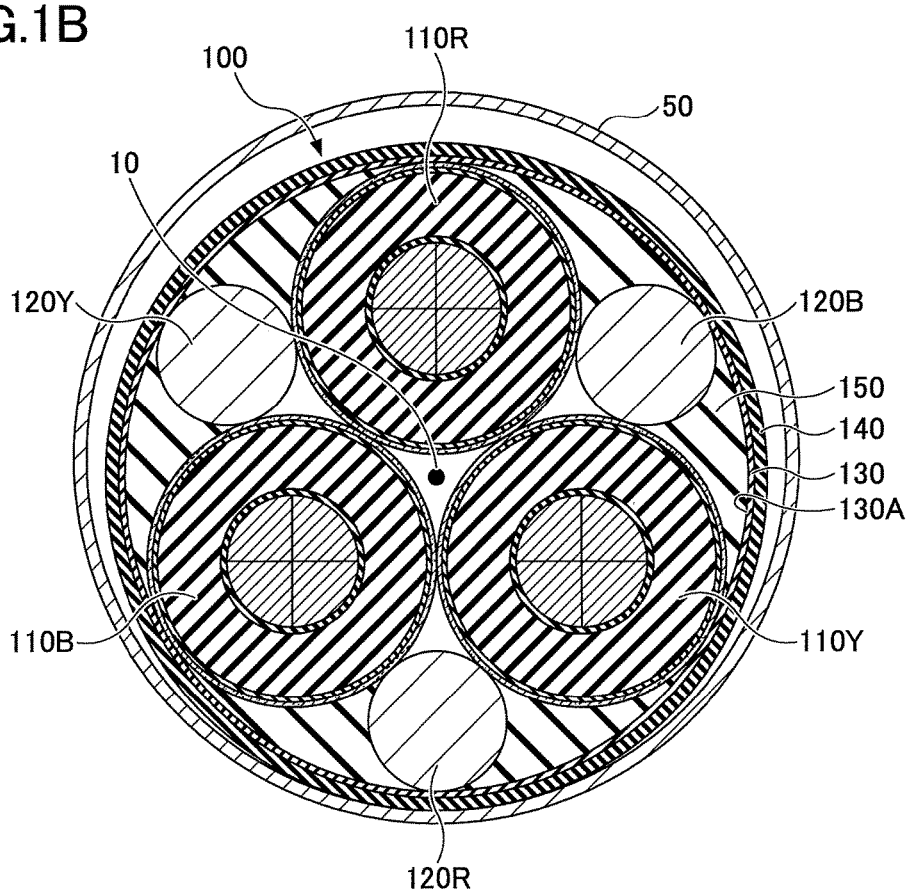

FIGS. 1A and 1B are diagrams illustrating a power cable 100 in one embodiment. FIG. 1A illustrates a perspective view of the power cable 100, and FIG. 1B illustrates a cross sectional view of the power cable 100 taken in a direction perpendicular to a longitudinal direction of the power cable 100. FIGS. 1A and 1B illustrate a state in which the power cable 100 is cut along a plane perpendicular to the longitudinal direction of the power cable 100.

The power cable 100 is provided inside a steel pipe 50, and includes transmission cables 110R, 110Y, and 110B, ground buses 120R, 120Y, and 120B, a binder 130, a corrosion-proof layer 140, and a resin member 150. The power cable 100 is provided between 2 electric power substations.

The steel pipe 50 is formed by a pipe made of iron, for example. The transmission cables 110R, 110Y, and 110B, the ground buses 120R, 120Y, and 120B, the binder 130, and the corrosion-proof layer 140 are inserted through the inside of the steel pipe 50. The steel pipe 50 is electrically connected to a reference potential node. In one embodiment, the steel pipe 50 is grounded, for example, and is held at a ground potential. The steel pipe 50 is held at a reference potential, in order to use the steel pipe 50 as a return path for a fault current in a case in which the fault current caused by ground fault or the like flows through the transmission cables 110R, 110Y, and 110B.

The steel pipe 50 may be a new, unused steel pipe, or an old, used steel pipe. For example, when replacing an existing power cable by the power cable 100 in one embodiment, the steel pipe of the existing power cable may be reused as the steel pipe 50 of the power cable 100.

More particularly, the steel pipe of the existing POF cable, for example, after removing the transmission cables and an insulating oil therefrom and cleaning, may be reused as the steel pipe 50. In one embodiment, an inner diameter of the steel pipe 50 is 260.35 mm (or 10.25 inches), for example.

In the cross sectional view illustrated in FIG. 1B, the transmission cables 110R, 110Y, and 110B are arranged at 3-fold rotationally symmetrical positions with respect to a center through which a virtual center line 10 passes, so that center axes thereof substantially correspond to 3 vertexes of an equilateral triangle. In this state, semiconductive beddings of adjacent transmission cables of the transmission cables 110R, 110Y, and 110B make contact with each other. In addition, the transmission cables 110R, 110Y, and 110B are twisted around the virtual center line 10 along a longitudinal direction of the power cable 100. The transmission cables 110R, 110Y, and 110B are used to transmit power of each phase of 3-phase AC power. The transmission cables 110R, 110Y, and 110B are examples of 3 transmission cables.

The transmission cables 110R, 110Y, and 110B have outer diameters so as to inscribe a circle 130A in the cross sectional view illustrated in FIG. 1B, in a state in which the transmission cables 110R, 110Y, and 110B are arranged at 3-fold rotationally symmetrical positions with respect to the center through which the virtual center line 10 passes. A radius of the circle 130A in the cross sectional view corresponds a radius of an envelope circle of a power cable having a maximum radius that may be provided inside the steel pipe 50, but excluding thicknesses of the binder 130 and the corrosion-proof layer 140. This arrangement of the transmission cables 110R, 110Y, and 110B can maximize cross sectional areas of the transmission cables 110R, 110Y, and 110B under a condition in which an inner diameter of the steel pipe 50 is restricted.

The envelope circle of the power cable having the maximum radius that may be provided inside the steel pipe 50 in the cross sectional view is a circle having a minimum radius but including the cross sectional area of the power cable having the maximum radius that may be provided inside the steel pipe 50. A diameter of the envelope circle has a dimension that is obtained by subtracting, from the inner diameter of the steel pipe 50, a margin required to insert the power cable 100 having a length of 609.60 m (or 2000 feet) or greater through the steel pipe 50 having a length of 609.60 m (or 2000 feet) and the inner diameter of 155.8 mm (or 6.12 inches) to 260.35 mm (or 10.25 inches), for example.

The transmission cables 110R, 110Y, and 110B having maximum outer diameters that may be provided inside the steel pipe 50 in the cross sectional view, excluding the thicknesses of the binder 130 and the corrosion-proof layer 140, inscribe the circle 130A. In other words, in the cross sectional view, the circle 130A is prescribed by an inner peripheral surface of the binder 130.

For example, the transmission cables 110R, 110Y, and 110B may be categorized as red-phase, yellow-phase, and blue-phase cables, respectively, permitting identification of the cables by color. The transmission cables 110R, 110Y, and 110B have different colors for identification, but have the same configuration. For this reason, when not distinguishing the transmission cables 110R, 110Y, and 110B, these transmission cables 110R, 110Y, and 110B may also be referred to as "transmission cables 110" in the following description. The detailed configuration of the transmission cable 110 will be described later in conjunction with FIGS. 2A and 2B.

The ground buses 120R, 120Y, and 120B are wires that are made of a conductor, such as aluminum, copper, or the like, for example, and are held at the ground potential. Each of the ground buses 120R, 120Y, and 120B is made up of a plurality of thin wires that are twisted to form a single wire. Each of the ground buses 120R, 120Y, and 120B does not have a sheath or a corrosion-proof layer, such as an insulator layer, covering an outer periphery thereof. In other words, the ground buses 120R, 120Y, and 120B are bare conductor wires. The ground buses 120R, 120Y, and 120B are provided to flow currents to the electric power substations when a fault occurs. Both ends of each of ground buses 120R, 120Y, and 120B are grounded.

In the cross sectional view, the ground buses 120R, 120Y, and 120B are arranged at 3-fold rotationally symmetrical positions with respect to the center through which the virtual center line 10 passes, and in contact with the outer peripheral surfaces of the transmission cables 110R, 110Y, and 110B. The ground buses 120R, 120Y, and 120B are arranged at diagonal positions with respect to the transmission cables 110R, 110Y, and 110B.

More particularly, the ground bus 120R is fitted into a valley formed by the outer peripheral surfaces of the transmission cables 110Y and 110B, the ground bus 120B is fitted into a valley formed by the outer peripheral surfaces of the transmission cables 110R and 110Y, and the ground bus 120Y is fitted into a valley formed by the outer peripheral surfaces of the transmission cables 110B and 110R.

The ground buses 120R, 120Y, and 120B are mutually connected at both ends thereof, and mutually electrically connected to form a triangular prism shaped closed loop. The ground buses 120R, 120Y, and 120B ground the surfaces of the transmission cables 110R, 110Y, and 110B by making contact with the semiconductive beddings at outermost peripheral surfaces of the transmission cables 110R, 110Y, and 110B.

In addition, the ground buses 120R, 120Y, and 120B have outer diameters making contact with the circle 130A. The ground buses 120R, 120Y, and 120B make contact with the inner peripheral surface of the binder 130. Hence, among the transmission cables 110R, 110Y, and 110B, and the ground buses 120R, 120Y, and 120B, portions that project most in a radial direction from the virtual center line 10 when viewed in the cross sectional view are located on the circle 130A.

No insulator layer or the like is provided to cover the outer peripheral surfaces of the ground buses 120R, 120Y, and 120B, and the ground buses 120R, 120Y, and 120B have the outer diameters so as to make contact with the circle 130A, for the following reasons. That is, the above described configuration and arrangement are employed in order to maximize the outer diameters of the ground buses 120R, 120Y, and 120B in a marginal space at outer peripheral parts of the transmission cables 110R, 110Y, and 110B within the envelope circle described above, and to ground the surfaces of the transmission cables 110R, 110Y, and 110B through the semiconductive beddings. At the surface of each of the transmission cables 110R, 110Y, and 110B, a charging current supplied from a conductor wire 111 and leaking via an insulating layer 113 causes a phenomenon in which a surface potential of an insulating layer 113 floats. For this reason, grounding is not only required in the longitudinal direction of the power cable 100, but also in the radial direction of the power cable 100. The transmission cables 110R, 110Y, and 110B are grounded in the radial direction by being in contact with the ground buses 120R, 120Y, and 120B.

The ground buss 120R, 120Y, and 120B have the same configuration. For this reason, when not distinguishing the ground buses 120R, 120Y, and 120B, these ground buses 120R, 120Y, and 120B may also be referred to as "ground buses 120" in the following description.

The binder 130 is an insulating layer or a binder tape that binds the transmission cables 110R, 110Y, and 110B, and the ground buses 120R, 120Y, and 120B, by covering the outer peripheral surfaces of the transmission cables 110R, 110Y, and 110B, and the ground buses 120R, 120Y, and 120B.

The corrosion-proof layer 140 is provided on the binder 130, to overlap the binder 130. The corrosion-proof layer 140 is an insulator layer that covers the outer peripheral surfaces of the transmission cables 110R, 110Y, and 110B, and the ground buses 120R, 120Y, and 120B via the binder 130. The corrosion-proof layer 140 is an example of a jacket.

The resin member 150 is arranged between the transmission cables 110R, 110Y, and 110B, and the ground buses 120R, 120Y, and 120B, inside the binder 130 and the corrosion-proof layer 140. The resin member 150 is made of an insulating material, such as a polypropylene string-shaped member, for example.

The resin member 150 fills gaps between the transmission cables 110R, 110Y, and 110B, and the ground buses 120R, 120Y, and 120B, inside the binder 130 and the corrosion-proof layer 140. In the cross sectional view, the resin member 150 fills the inside of the binder 130 so that a closed curve prescribed by the inner peripheral surface of the binder 130 becomes a circle.

Figure 2A:
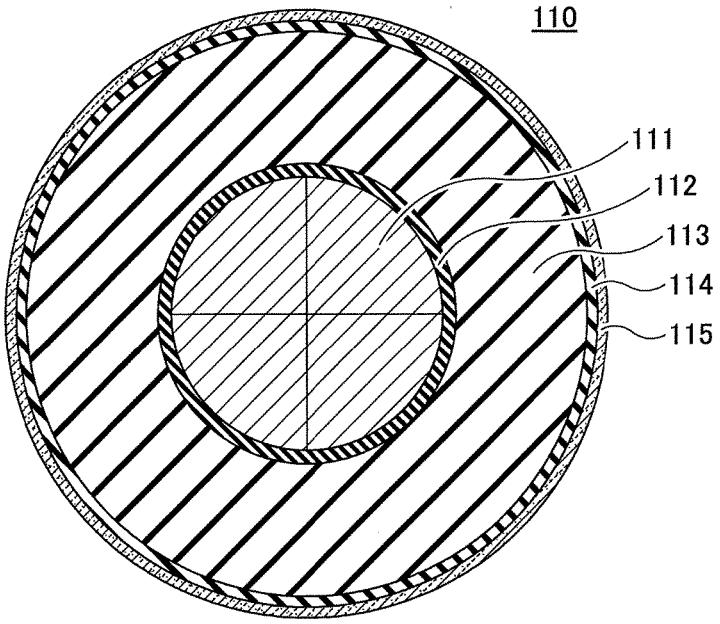
FIGS. 2A and 2B are diagrams illustrating a transmission cable 110 of the power cable 100 in one embodiment.
Figure 2B:
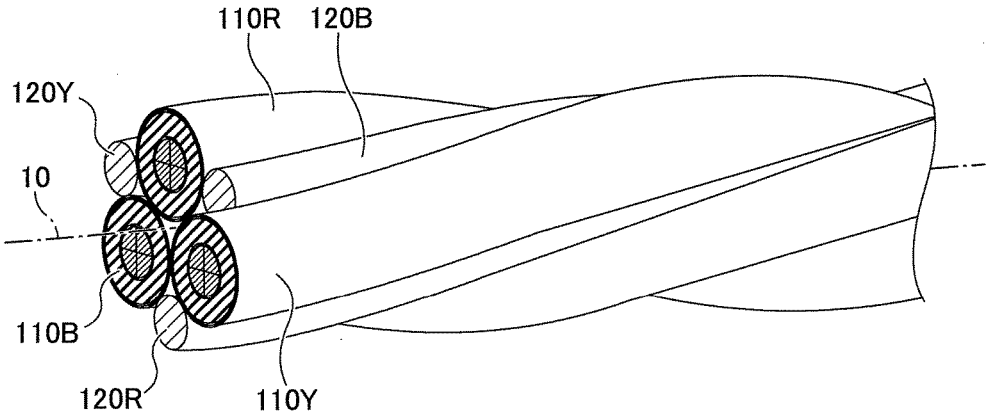

Next, a more detailed description will be given on the transmission cables 110, by referring to FIGS. 2A and 2B. FIGS. 2A and 2B are diagrams illustrating the transmission cable 110 of the power cable 100 in one embodiment. FIG. 2A illustrates a cross sectional view of the transmission cable 110 taken in the direction perpendicular to the longitudinal direction of the power cable 100, and FIG. 2B illustrates a perspective view of a triplex formation of the transmission cables 110. FIG. 2B also illustrates the ground buses 120R, 120Y, and 120B in addition to the transmission cables 110R, 110Y, and 110B.

As illustrated in FIG. 2A, the transmission cable 110 includes the conductor wire 111, a conductor screen 112, the insulating layer 113, an insulator screen 114, and a semiconductive bedding 115.

The conductor wire 111 is made of a metal, and may be formed by a copper wire, for example. The conductor wire 111 of the transmission cable 110 is used to transmit power. The conductor wire 111 is made up of a plurality of thin conductor wires that are twisted to form a single wire.

The conductor screen 112 is formed by a semiconductive tape that is heat-resistant, and a resin layer including conductive powder. The conductor screen 112 is wrapped around a periphery of the conductor wire 111. For example, nylon or polyester may be used for the semiconductive tape that is heat-resistant. For example, EEA (Ethylene-Ethylacrylate Copolymer) resins including carbon powder may be used for the resin layer including the conductive powder.

The insulating layer 113 is provided to electrically insulate the conductor wire 111. For example, the insulating layer 113 may be injection molded using a material such as an XLPE (Cross Linked Poly-Ethylene). Although XLPE is used for the insulating layer 113 in this example, any material other than XLPE, that is heat-resistant and insulative, may be used for the insulating layer 113.

The insulator screen 114 is formed by a resin layer including carbon powder. The insulator screen 114 is wrapped around the periphery of the insulating layer 113. For example, EEA resins may be used for the resin layer including the carbon powder.

The semiconductive bedding 115 is formed by a so-called bedding tape that is semiconductive. The semiconductive bedding 115 is an example of a semiconductive layer, and is wrapped around the periphery of the insulator screen 114.

The transmission cables 110R, 110Y, and 110B illustrated in FIGS. 1A and 1B and having the configuration described above are twisted around the virtual center line 10, with respect to the center through which the virtual center line 10 passes, along the longitudinal direction of the power cable 100 (or virtual center line 10), as illustrated in FIG. 2B. The 3 transmission cables 110R, 110Y, and 110B are twisted in this manner to form the triplex formation.

In addition, the ground buses 120R, 120Y, and 120B are twisted around the peripheries of the transmission cables 110R, 110Y, and 110B.

The triplex formation of the transmission cables 110R, 110Y, and 110B in the cross sectional view maintains the 3-fold rotationally symmetrical positions of the transmission cables 110R, 110Y, and 110B with respect to the center through which the virtual center line 10 passes, while being twisted around the virtual center line 10. The triplex formation introduces only small contraction and expansion of the transmission cables 110R, 110Y, and 110B along the longitudinal direction of the power cable 100, and facilitates connection of power cables 100 inside a manhole, for example.

The 3-fold rotationally symmetrical positions of the transmission cables 110R, 110Y, and 110B in the cross sectional view is not limited to positional relationships in which the transmission cables 110R, 110Y, and 110B are arranged at positions that are perfectly 3-fold symmetrical and perfectly rotationally symmetrical to each other. In other words, even in a case in which positional errors of the transmission cables 110R, 110Y, and 110B are generated due to inconsistencies in the twisting of the transmission cables 110R, 110Y, and 110B, it is assumed that the 3-fold rotationally symmetrical positions of the transmission cables 110R, 110Y, and 110B in the cross section are maintained.

In one embodiment, the transmission cables 110R, 110Y, and 110B having the triplex formation are arranged along the outer periphery of the virtual center line 10, and further, the ground buses 120R, 120Y, and 120B are twisted around the outer peripheries of the transmission cables 110R, 110Y, and 110B. Further, the power cable 100 is arranged inside the steel pipe 50 as illustrated in FIGS. 1A and 1B, in a state in which the transmission cables 110R, 110Y, and 110B, and the ground buses 120R, 120Y, and 120B are covered by the binder 130 and the corrosion-proof layer 140.

The power cable 100 in one embodiment transmits the 3-phase AC power by the transmission cables 110R, 110Y, and 110B illustrated in FIGS. 1A and 1B. For example, a current carrying capacity is 800 MVA (345 kV, 1339 A). However, this current carrying capacity of 800 MVA is merely an example, and the current carrying capacity may vary depending on laying conditions such as a temperature, a depth at which the steel pipe 50 is buried, or the like.

As an example, the length of the power cable 100 is 609.60 m (or 2000 feet), and a plurality of power cables 100 are connected in series and used. In this case, between 2 power cables 100 that are connected, the transmission cables having the same color are connected together. In other words, the transmission cable 110R of a first power cable 100 is connected to the transmission cable 110R of a second power cable 100, the transmission cable 110Y of the first power cable 100 is connected to the transmission cable 110Y of the second power cable 100, and the transmission cable 110B of the first power cable 100 is connected to the transmission cable 110B of the second power cable 100. More particularly, the conductor wires 111 of the transmission cables 110R of the first and second power cables 100 are connected, the conductor wires 111 of the transmission cables 110Y of the first and second power cables 100 are connected, and the conductor wires 111 of the transmission cables 110B of the first and second power cables 100 are connected.

When replacing a part of a plurality of power cables connected in series inside the steel pipe 50 that is already laid, the power cables 100 may be used as new replacement power cables. In a case in which one of a plurality of existing power cables connected in series inside the steel pipe that is already laid is to be replaced, for example, the power cable 100 may be used as the new replacement power cable. In this case, when the existing power cable that is removed to be replaced is provided inside the steel pipe similar to the steel pipe 50, and the power cable 100 can be inserted inside the steel pipe, the steel pipe of the existing power cable may be reused as the steel pipe 50.

Further, in the case described above, at both ends of the power cable 100, the conductor wires 111 of the transmission cables 110R, 110Y, and 110B may be connected to the conductor wires of the transmission cables of the corresponding phase and color of the existing power cable. In this case, the ground buses 120R, 120Y, and 120B of the power cable 100 are grounded to a ground node having the reference potential at the 2 electric power substations.

Figure 3:
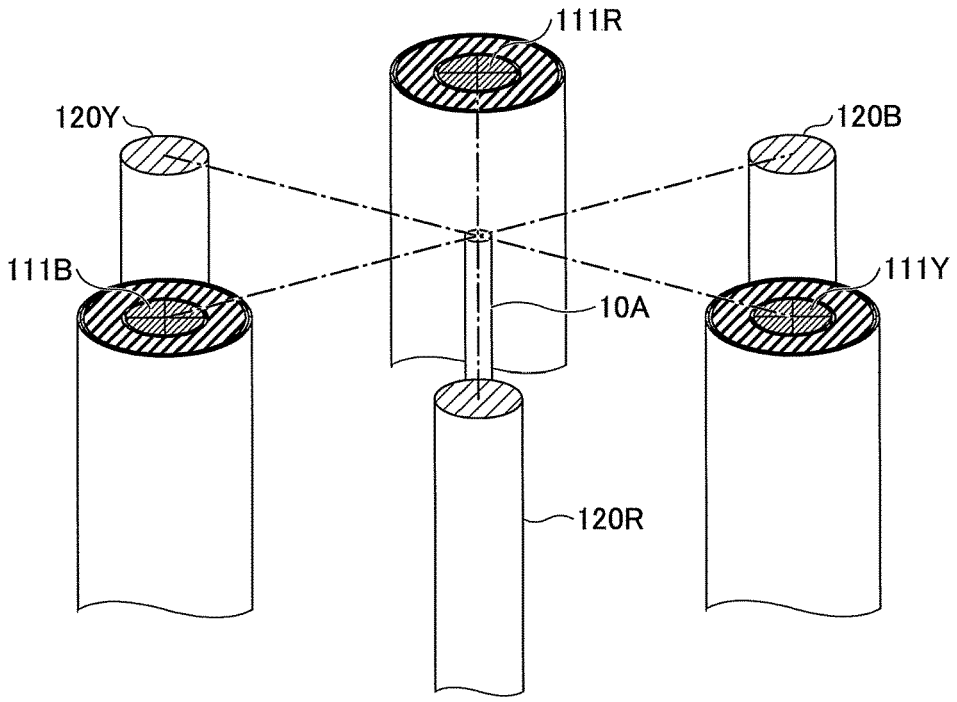
FIG. 3 is a diagram illustrating positional relationships of transmission cables 110R, 110Y, and 100B, and ground buses 120R, 120Y, and 120B.

FIG. 3 is a diagram illustrating positional relationships of the transmission cables 110R, 110Y, and 100B, and the ground buses 120R, 120Y, and 120B. In FIG. 3, the conductor wires 111 of the transmission cables 110R, 110Y, and 110B are distinguished from each other and designated as conductor wires 111R, 111Y, and 111B.

In addition, FIG. 3 illustrates a virtual ground path 10A. In the cross sectional view, this virtual ground path 10A passes through the center of the transmission cables 110R, 110Y, and 110B, and the ground buses 120R, 120Y, and 120B. The virtual ground path 10A is positioned on, or coincides with, the virtual center line 10 illustrated in FIGS. 1A and 1B. The virtual ground path 10A is a virtual path connected to the ground buses 120R, 120Y, and 120B at both ends of the power cable 100, and is held at the ground potential.

The ground buses 120R, 120Y, and 120B have the same configuration, and are arranged at rotationally symmetrical positions with respect to the virtual ground path 10A. Hence, a more detailed description will be given on the ground bus 120R, by referring to FIG. 4 in addition to FIG. 3.

Figure 4:
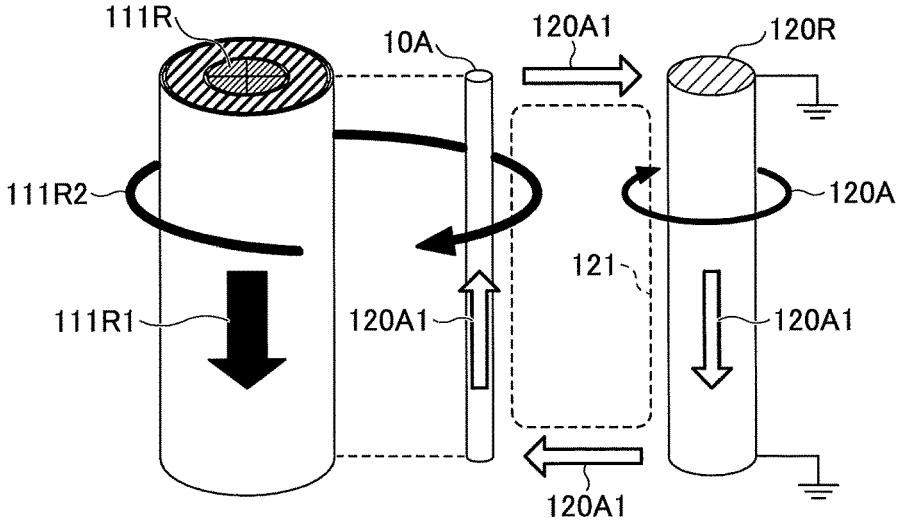
FIG. 4 is a diagram illustrating relationships of currents flowing through a conductor wire 111R, the ground bus 120R, and a virtual ground path 10A, and a magnetic field.

FIG. 4 is a diagram illustrating relationships of currents flowing through the conductor wire 111R, the ground bus 120R, and the virtual ground path 10A, and a magnetic field. Because both ends of each of the ground buses 120R, 120Y, and 120B are grounded, a ground symbol is indicated at both ends of the ground bus 120R in FIG. 4.

The ground bus 120R and the virtual ground path 10A form a closed loop 121 indicted by a dotted line. When a current 111R1 flows through the conductor wire 111R as indicated by a downwardly pointing arrow in FIG. 4, a magnetic field 111R2 is generated according to the right-handed screw rule in a direction indicated by an upwardly pointing arrow in FIG. 4. For this reason, a magnetic field 120A is generated in the ground bus 120R in a direction to cancel the magnetic field 111R2, and a current 120A1 is generated in the ground bus 120R by the magnetic field 120A in a direction indicated by a downwardly pointing arrow in FIG. 4. As a result, the current 120A1 flows through the closed loop 121. The current 120A1 is both an induced current and a circulating current.

A description is given above with respect to 1 phase of the 3-phase AC current (R, Y, and B), using the relationship of the conductor wire 111R, the ground bus 120R, and the virtual ground path 10A. However, a similar relationship stands for the conductor wire 111Y, the ground bus 120Y, and the virtual ground path 10A, and a similar relationship also stands for the conductor wire 111B, the ground bus 120B, and the virtual ground path 10A.

Because circulating currents differing in phase by 120 degrees due to the 3-phase AC current (R, Y, and B) flow through the virtual ground path 10A, a total current flowing through the virtual ground path 10A becomes zero. Accordingly, virtual grounding can be made using the virtual ground path 10A.

The magnetic field 111R2 generated by the current 111R1 flowing through the conductor wire 111R, and the magnetic field 111R2 generated in the ground bus 120R, penetrate the closed loop 121 and are generated in directions so as to mutually cancel each other. However, a phase difference is generated between the magnetic field 111R2 generated by the current 111R1 flowing through the conductor wire 111R, and the magnetic field 111R2 generated in the ground bus 120R, due to an AC resistance of the ground bus 120R.

A circulating current $I_{ECC}$ (A), that is, the current 120A1, can be approximated from the following formula (2), where $I_C$ (A) denotes the current 111R1 flowing through the conductor wire 111R, ω denotes an AC angular frequency, M (Ω/m) denotes a mutual impedance of the conductor wire 111R and the ground bus 120R, $R_{ECC}$ (Ω/m) denotes an AC resistance of the ground bus 120R, and $X_{ECC}$ (Ω/m) denotes a reactance of the ground bus 120R.

$$I_{ECC}=I_C\times\{j\omega M/(R_{ECC}+jX_{ECC})\} \quad (2)$$

In order to maximize the circulating current $I_{ECC}$, the reactance $X_{ECC}$ of the ground bus 120R may be minimized. The reactance $X_{ECC}$ (Ω/m) is represented by the following formula (3), where f (Hz) denotes a frequency of the AC power, r (mm) denotes the outer diameter of the ground bus 120R, and D (mm) denotes a distance between the center of the ground bus 120R and the virtual ground path 10A.

$$X_{ECC}=4\pi f\ln(D/r)\times10^{-7} \quad (3)$$

It may be seen from the formula (3) above that the reactance $X_{ECC}$ can be minimized and the circulating current $I_{ECC}$ can be maximized, by maximizing the outer diameter r of the ground bus 120R. For this reason, the ground buses 120R, 120Y, and 120B have outer diameters so as to inscribe the circle 130A in the cross sectional view illustrated in FIG. 1B.

In this example, an absolute value $|I_{ECC}/I_C|$ of a current ratio of the circulating current $I_{ECC}$ flowing through the ground bus 120R to the current $I_C$ (that is, the current 111R1) flowing through the conductor wire 111R becomes approximately 35%. Hence, the circulating current $I_{ECC}$, amounting to approximately 35% of the current $I_C$ flowing through the conductor wire 111R, can be induced to the ground bus 120R. The absolute value $|I_{ECC}/I_C|$ of the current ratio of the circulating current $I_{ECC}$ to the current $I_C$ may be obtained by electromagnetic field simulation.

Similarly, a circulating current $I_{ECC}$, amounting to approximately 35% of a current $I_C$ flowing through the conductor wire 111Y, can be induced to the ground bus 120Y. Further, a circulating current $I_{ECC}$, amounting to approximately 35% of a current $I_C$ flowing through the conductor wire 111B, can be induced to the ground bus 120B. The absolute value $|I_{ECC}/I_C|$ of the current ratio of the circulating current $I_{ECC}$ flowing through the ground bus 120Y to the current $I_C$ flowing through the conductor wire 111Y may also be obtained by electromagnetic field simulation. Similarly, the absolute value $|I_{ECC}/I_C|$ of the current ratio of the circulating current $I_{ECC}$ flowing through the ground bus 120B to the current $I_C$ flowing through the conductor wire 111B may also be obtained by electromagnetic field simulation.

In the example described above, the ground buses 120R, 120Y, and 120B have the outer diameters that are maximized so as to inscribe the circle 130A in the cross sectional view illustrated in FIG. 1B. However, the ground buses 120R, 120Y, and 120B may have outer diameters slightly smaller than the maximized outer diameters.

The ground buses 120R, 120Y, and 120B may have outer diameters such that, in a state in which the ground buses 120R, 120Y, and 120B are twisted around the outer peripheral surfaces of the transmission cables 110R, 110Y, and 110B and the resin member 150 is not provided, the ground buses 120R, 120Y, and 120B can be supported by the binder 130. In other words, the outer diameters of the ground buses 120R, 120Y, and 120B may be greater than or equal to a value that enables the binder 130 to support the ground buses 120R, 120Y, and 120B in this state.

Figure 5:
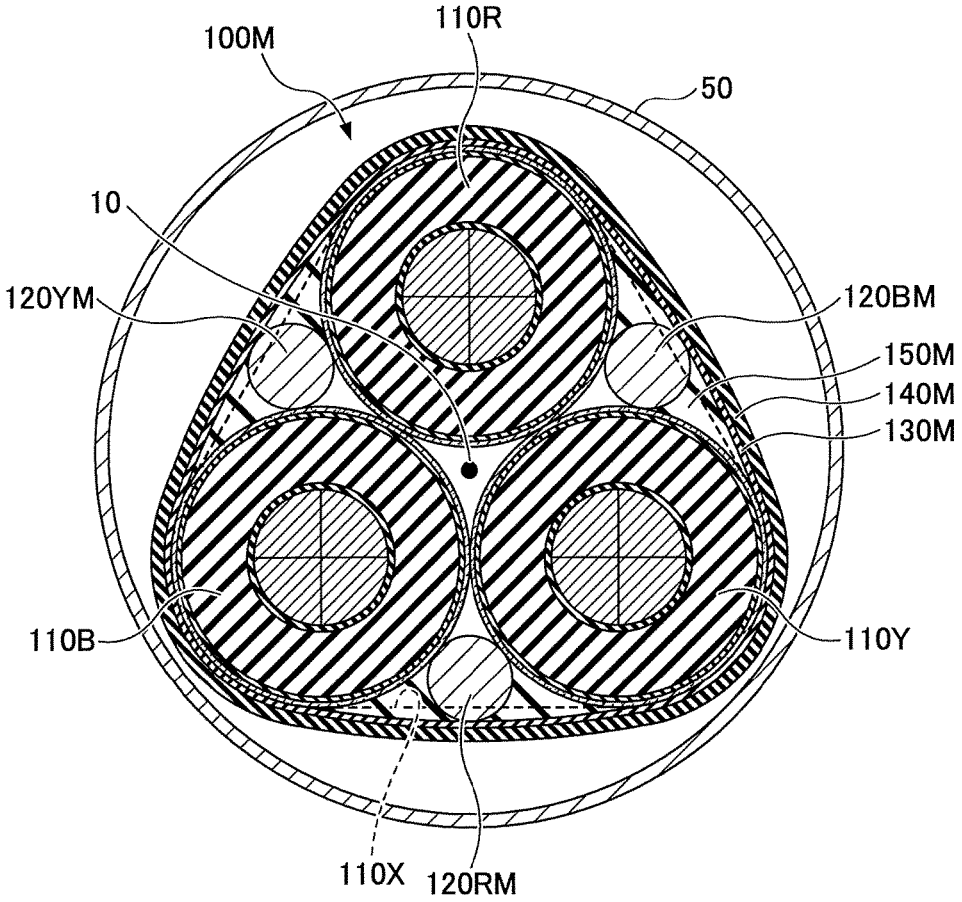
FIG. 5 is a diagram illustrating a cross sectional view of a power cable 100M in a modification of one embodiment.

FIG. 5 is a diagram illustrating a cross sectional view of a power cable 100M in a modification of one embodiment. The cross sectional view of the power cable 100M illustrated in FIG. 5 corresponds to the cross sectional view of the power cable 100 illustrated in FIG. 1B, and is taken in a direction perpendicular to a longitudinal direction of the power cable 100M.

The power cable 100M includes the transmission cables 110R, 110Y, and 110B, ground buses 120RM, 120YM, and 120BM, a binder 130M, a corrosion-proof layer 140M, and a resin member 150M.

The ground buses 120RM, 120YM, and 120BM have outer diameters such that the ground buses 120RM, 120YM, and 120BM project in a radial direction from a virtual center line 10, outwardly of an envelope closed curve 110X of the 3 transmission cables 110R, 110Y, and 110B. The envelope closed curve 110X surrounds the outer peripheries of the 3 transmission cables 110R, 110Y, and 110B that are arranged at 3-fold rotationally symmetrical positions with respect to a center through which the virtual center line 10 passes.

In FIG. 5, the envelope closed curve 110X is indicated by a dotted line at linear portions between the outer peripheries of the transmission cables 110R and 110Y, between the outer peripheries of the transmission cables 110Y and 110B, and between the outer peripheries of the transmission cables 110B and 110R. The envelope closed curve 110X at portions other than the 3 linear portions indicated by the dotted line, extend along the outer peripheries of the transmission cables 110R, 110Y, and 110B. The envelope closed curve 110X has a shape approximately corresponding to a triangle having 3 vertexes thereof rounded along the outer peripheries of the transmission cables 110R, 110Y, and 110B.

The outer diameters of the ground buses 120RM, 120YM, and 120BM that project outwardly of the envelope closed curve 110X are greater than outer diameters of the ground buses 120RM, 120YM, and 120BM for a case in which the ground buses 120RM, 120YM, and 120BM inscribe the envelope closed curve 110X. When the outer diameters of the ground buses 120RM, 120YM, and 120BM that project outwardly of the envelope closed curve 110X are greater than outer diameters of the ground buses 120RM, 120YM, and 120BM for the case in which the ground buses 120RM, 120YM, and 120BM inscribe the envelope closed curve 110X, the ground buses 120RM, 120YM, and 120BM can be supported by the binder 130M.

In the state in which the ground buses 120RM, 120YM, and 120BM are supported by the binder 130M, tensions caused by outwardly pressing forces of the ground buses 120RM, 120YM, and 120BM are applied to the binder 130M.

The outer diameters of the ground buses 120RM, 120YM, and 120BM preferably are minimum outer diameters with which the ground buses 120RM, 120YM, and 120BM project outwardly of the envelope closed curve 110X. The outer diameters of the ground buses 120RM, 120YM, and 120BM are smaller than the outer diameters of the ground buses 120R, 120Y, and 120B in one embodiment described above. Preferably, the outer diameters of the ground buses 120RM, 120YM, and 120BM are minimum outer diameters among the outer diameters of the ground buses 120R, 120Y, and 120B in one embodiment and the outer diameters of the ground buses 120RM, 120YM, and 120BM of this modification of one embodiment.

The binder 130M is similar to the binder 130 illustrated in FIGS. 1A and 1B. However, the binder 130M binds the transmission cables 110R, 110Y, and 110B, and the ground buses 120RM, 120YM, and 120BM, by covering the outer peripheral surfaces of the transmission cables 110R, 110Y, and 110B, and the ground buses 120RM, 120YM, and 120BM. The binder 130M projects outwardly by an amount the ground buses 120RM, 120YM, and 120BM project outwardly from the envelope closed curve 110X. For this reason, stress is applied on the ground buses 120 towards the transmission cables 110, to positively ground the surfaces of the transmission cables 110 by the ground buses 120.

The corrosion-proof layer 140M is similar to the corrosion-proof layer 140 illustrated in FIGS. 1A and 1B. However, the corrosion-proof layer 140M is provided to overlap the binder 130M, and covers the outer peripheral surfaces of the transmission cables 110R, 110Y, and 110B, and the ground buses 120RM, 120YM, and 120BM via the binder 130M. The corrosion-proof layer 140M is an example of the jacket.

The resin member 150M is similar to the resin member 150 illustrated in FIGS. 1A and 1B. However, the resin member 150M is arranged so as not to press outwardly the binder 130M and the corrosion-proof layer 140M that cover the outer peripheral surfaces of the transmission cables 110R, 110Y, and 110B, and the ground buses 120RM, 120YM, and 120BM. In other words, the resin member 150M is arranged so as to maintain the shapes of the binder 130M and the corrosion-proof layer 140M that cover the outer peripheral surfaces of the transmission cables 110R, 110Y, and 110B, and the ground buses 120RM, 120YM, and 120BM.

The shapes of the binder 130M and the corrosion-proof layer 140M that cover the outer peripheral surfaces of the transmission cables 110R, 110Y, and 110B, and the ground buses 120RM, 120YM, and 120BM are the same as the shape of the envelope closed curve 110X covering the outer peripheral surfaces of the transmission cables 110R, 110Y, and 110B, and the ground buses 120RM, 120YM, and 120BM.

In the power cable 100M described above, the absolute value $|I_{ECC}/I_C|$ of the current ratio of the circulating current $I_{ECC}$ flowing through the ground bus 120RM to the current $I_C$ flowing through the conductor wire 111R, for example, is approximately 25%. Hence, the circulating current $I_{ECC}$, amounting to approximately 25% of the current $I_C$ flowing through the conductor wire 111R, for example, can be induced to the ground bus 120RM.

Figures 6, 7:
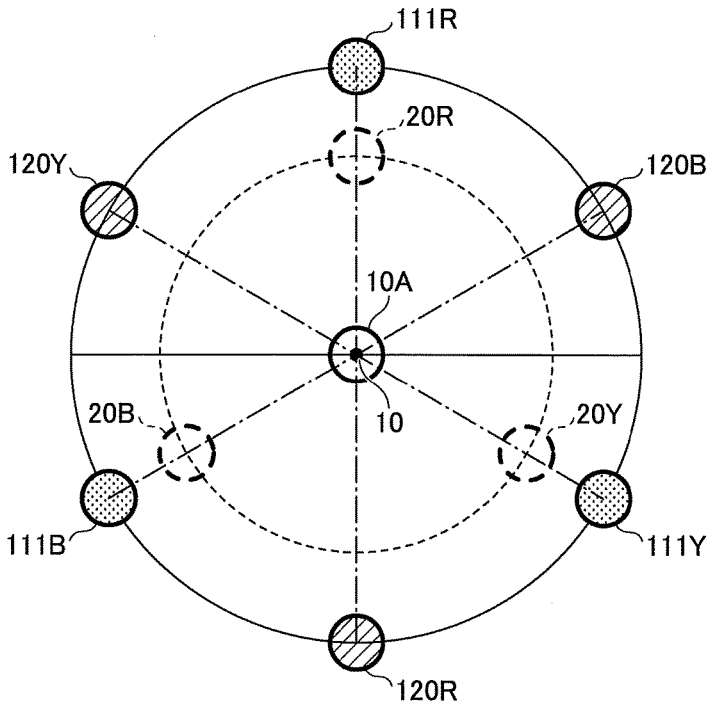
FIG. 6 is a diagram illustrating a geometrical center position of a current $I_c$ flowing through conductor wires 111R, 111Y, and 111B, and a circulating current $I_{ECC}$ flowing through the ground buses 120R, 120Y, and 120B.
FIG. 7 is a diagram illustrating cross sectional area of ground buses, the current ratio, heat generation rate, the magnetic field at an outer surface of a steel pipe 50, and the iron loss, for a power cable 1000 of a comparison example, and the power cables 100 and 100M.

FIG. 6 is a diagram illustrating a geometrical center position of the current $I_c$ flowing through conductor wires 111R, 111Y, and 111B, and the circulating current $I_{ECC}$ flowing through the ground buses 120R, 120Y, and 120B.

The geometrical center position of the current $I_c$ flowing through conductor wire 111R, for example, is approximately closer to the virtual center line 10 than to the conductor wire 111R and is located on the inner side, due to the circulating current $I_{ECC}$ of the same phase flowing through the ground bus 120R. In a case in which the circulating current $I_{ECC}$ flowing through the ground bus 120R is 30% of the current $I_c$ flowing through conductor wire 111R, the geometrical center position of the current $I_c$ flowing through conductor wire 111R is a position 20R illustrated in FIG. 6, located at a distance that is 70% of the distance from the virtual center line 10 to the conductor wire 111R. This is equivalent to substantially reducing the correlation length among the conductor wires 111R, 111Y, and 111B.

The circulating current $I_{ECC}$ flowing through the ground bus 120R is set to 30% of the current $I_c$ flowing through conductor wire 111R, because the absolute value $|I_{ECC}/I_C|$ of the current ratio of the circulating current $I_{ECC}$ flowing through the ground bus 120R to the current $I_C$ flowing through the conductor wire 111R in the power cable 100 illustrated in FIGS. 1A and 1B is approximately 35%, and the corresponding absolute value $|I_{ECC}/I_C|$ of the current ratio of the circulating current $I_{ECC}$ flowing through the ground bus 120RM to the current $I_C$ flowing through the conductor wire 111R in the power cable 100M illustrated in FIG. 5 is approximately 25%. In other words, the circulating current $I_{ECC}$ flowing through the ground bus 120R is set to 30% of the current $I_c$ flowing through conductor wire 111R, that is an intermediate value between the absolute values $|I_{ECC}/I_C|$ of the current ratios, namely, approximately 35% and approximately 25%.

Similarly, the geometrical center position of the current $I_c$ flowing through conductor wire 111Y is a position 20Y illustrated in FIG. 6, located at a distance that is 70% of the distance from the virtual center line 10 to the conductor wire 111Y. Further, the geometrical center position of the current $I_c$ flowing through conductor wire 111B is a position 20B illustrated in FIG. 6, located at a distance that is 70% of the distance from the virtual center line 10 to the conductor wire 111B.

As may be seen from the formula (1) described above, the iron loss is approximately proportional to the correlation length S of the power cable, and becomes smaller as the correlation length S becomes narrower. The iron loss becoming smaller corresponds to the iron loss becoming smaller due to center distances (or center-to-center spacing) among the conductor wires 111R, 111Y, and 111B becoming center distances (or center-to-center spacing) among the positions 20R, 20Y, and 20B.

FIG. 7 is a diagram illustrating cross sectional area of the ground buses, the current ratio, heat generation rate, the magnetic field at the outer surface of the steel pipe 50, and the iron loss for a power cable 1000 of a comparison example, and the power cables 100 and 100M.

In FIG. 7, the cross sectional area of the ground buses represents a ratio for a case in which the cross sectional area of the ground buses 120R, 120Y, and 120B is regarded as being 100%. The current ratio represents the absolute value $|I_{ECC}/I_C|$ of the current ratio of the circulating current $I_C$ flowing through the ground buses to the current $I_C$ flowing through the corresponding conductor wires in the power cable. The heat generation rate of the ground buses represents a ratio for a case in which the cross sectional area of the ground buses 120R, 120Y, and 120B is regarded as being times 1. The magnetic field at the outer surface of the steel pipe 50 represents a ratio for a case in which the magnetic field at the outer surface of the steel pipe of the power cable 1000 of the comparison example is regarded as being 100%. The iron loss represents a ratio for a case in which the iron loss of the power cable 1000 of the comparison example is regarded as being 100%.

As illustrated in FIG. 7, the cross sectional area of the ground buses is 0% for the power cable 1000 of the comparison example because the power cable 1000 does not include ground buses. On the other hand, the cross sectional area of the ground buses is 100% for the power cable 100, and is 27% for the power cable 100M.

The current ratio is 0% for the power cable 1000 of the comparison example because the power cable 1000 does not include ground buses. On the other hand, the current ratio is 35% for the power cable 100, and is 25% for the power cable 100M. It may be seen from FIG. 7 that, the larger the cross section of the ground buses 120R, 120Y, and 120B, and the ground buses 120RM, 120YM, and 120BM, the smaller the current ratio.

The heat generation rate of the ground buses is times 0 for the power cable 1000 of the comparison example because the power cable 1000 does not include ground buses. On the other hand, the heat generation rate is times 1 for the power cable 100, and is times 1.9 for the power cable 100M. It may be seen from FIG. 7 that, although the circulating current $I_{ECC}$ flowing through the ground buses 120R, 120Y, and 120B is larger than the circulating current $I_{ECC}$ flowing through the ground buses 120RM, 120YM, and 120BM, the resistance is small because of the large cross sectional area of the ground buses 120R, 120Y, and 120B, to reduce the resistance and reduce the heat generation rate.

The magnetic field at the outer surface of the steel pipe 50 is 100% for the power cable 1000 of the comparison example, is 87% for the power cable 100, and is 90% for the power cable 100M. Hence, it may be seen that the larger the circulating current $I_{ECC}$ flowing through the ground buses 120RM, 120YM, and 120BM, the closer the distances of the 3-phase geometrical current positions. In addition, it may be seen that the shorter the correlation length of the transmission cables 110R, 110Y, and 110B, the smaller the magnetic field at the outer surface of the steel pipe 50.

The iron loss is generated proportionally to approximately the square of the magnetic field. However, results of the magnetic field simulations indicate that the iron loss is 100% for the power cable 1000 of the comparison example, is 70% for the power cable 100, and is 80% for the power cable 100M.

Therefore, it is confirmed that the current ratio increases, the magnetic field at the outer surface of the steel pipe 50 decreases, and the iron loss decreases for the power cables 100 and 100M, when compared to the power cable 1000 of the comparison example.

According to one embodiment, the transmission cables 110R, 110Y, and 110B of the power cable 100 have outer diameters so as to inscribe the circle 130A in the cross sectional view illustrated in FIG. 1B, in the state in which the transmission cables 110R, 110Y, and 110B are arranged at 3-fold rotationally symmetrical positions with respect to the center through which the virtual center line 10 passes. The radius of the circle 130A in the cross sectional view corresponds the radius of the envelope circle of the power cable having the maximum radius that may be provided inside the steel pipe 50, but excluding thicknesses of the binder 130 and the corrosion-proof layer 140.

Each of the transmission cables 110R, 110Y, and 110B includes the conductor wire 111, the conductor screen 112, the insulating layer 113, the insulator screen 114, and the semiconductive bedding 115. These constituent elements of each of the transmission cables 110R, 110Y, and 110B are minimized in order to increase the cross sectional area of the conductor wire 111. Hence, it is possible to maximize the cross sectional areas of the conductor wires 111 (that is, 111R, 111Y, and 111B) of the transmission cables 110R, 110Y, and 110B.

In addition, the ground buses 120R, 120Y, and 120B have outer diameters so as to inscribe the circle 130A, without providing a sheath or a corrosion-proof layer, such as an insulator layer, covering an outer periphery of the ground buses 120R, 120Y, and 120B. In other words, the outer peripheral surface of each of the ground buses 120R, 120Y, and 120B makes direct contact with the outer peripheral surfaces of two adjacent transmission cables of the transmission cables 110R, 110Y, and 110B. Hence, it is possible to maximize the outer diameter of the ground buses 120R, 120Y, and 120B.

Further, according to the modification of one embodiment, the ground buses 120RM, 120YM, and 120BM of the power cable 100M has outer diameters such that the ground buses 120RM, 120YM, and 120BM project in the radial direction from the virtual center line 10, outwardly of the envelope closed curve 110X of the 3 transmission cables 110R, 110Y, and 110B.

The geometrical center position of the current $I_C$ flowing through the conductor wires 111R, 111Y, and 111B of the transmission cables 110R, 110Y, and 110B can be offset towards the inner side by approximately 30% and closer to the virtual center line 10 than to the conductor wires 111R, 111R, and 111B, by using a combination of the transmission cables 110R, 110Y, and 110B, and the ground buses 120R, 120Y, and 120B of the power cable 100 described above, or by using a combination of the transmission cables 110R, 110Y, and 110B, and the ground buses 120RM, 120YM, and 120BM of the power cable 100M described above.

Accordingly, it is possible to reduce the iron loss at the transmission cables 110R, 110Y, and 110B, and provide the power cables 100 and 100M in which the total loss can be reduced by approximately 30%. In other words, it is possible to provide the power cables 100 and 100M which can reduce the iron loss and also increase the transmission power.

In one embodiment or the modification thereof described above, the outer diameters of the ground buses 120R, 120Y, and 120B are such that the ground buses 120R, 120Y, and 120B inscribe the circle 130A, or the outer diameters of the ground buses 120RM, 120YM, and 120BM are minimum outer diameters with which the ground buses 120RM, 120YM, and 120BM project outwardly of the envelope closed curve 110X of the 3 transmission cables 110R, 110Y, and 110B.

However, the outer diameters of the ground buses 120R, 120Y, and 120B or the ground buses 120RM, 120YM, and 120BM may be set to an arbitrary value between such outer diameters described above for the power cables 100 and 100M. In other words, the outer diameters of the ground buses 120R, 120Y, and 120B or the ground buses 120RM, 120YM, and 120BM may be set in a range greater than or equal to a diameter value projecting outwardly of the envelope closed curve 110X and less than or equal to a diameter value inscribing the circle 130A.

Accordingly, the outer diameters of the ground buses 120R, 120Y, and 120B or the ground buses 120RM, 120YM, and 120BM may be set in a range greater than or equal to a diameter value projecting outwardly of the envelope closed curve 110X and less than or equal to a diameter value of the circle 130A. The ground buses 120R, 120Y, and 120B have the maximum diameters less than or equal to the diameter value of the circle 130A, in the case in which the ground buses 120R, 120Y, and 120B have the outer diameters such that the ground buses 120R, 120Y, and 120B inscribe the circle 130A.

Hence, according to the embodiment and modification thereof described above, it is possible to provide a power cable with reduced iron loss and increased transmission power.

Further, the present invention is not limited to these embodiments and exemplary implementations, but various variations and modifications may be made without departing from the scope of the present invention.

What is claimed is:

1. A power cable to be provided inside a steel pipe that is electrically connected to a reference potential node, the power cable comprising:

three transmission cables respectively including one of three conductor wires configured to transmit 3-phase alternating current power, an insulating layer covering the one of the three conductor wires, and a semiconductive layer covering the insulating layer and forming an outer peripheral surface of one of the three transmission cables, wherein the three transmission cables are arranged at three-fold rotationally symmetrical positions with respect to a center of the three transmission cables in a cross sectional view in a state in which the semiconductive layers of adjacent transmission cables of the three transmission cables make contact with each other, and wherein the cross sectional view is taken in a direction perpendicular to a longitudinal direction of the power cable;

three ground buses respectively having an outer peripheral surface that is made of a conductor and is in direct contact with the outer peripheral surfaces of two adjacent transmission cables of the three transmission cables, and arranged at three-fold rotationally symmetrical positions with respect to the center of the three transmission cables in the cross sectional view;

a binder made of an insulator and in direct contact with and covering both the outer peripheral surfaces of the three ground buses and the outer peripheral surfaces of the three transmission cables; and a jacket made of an insulator and in direct contact with an outer peripheral surface of the binder to overlap the binder, wherein the three transmission cables have outer diameters so as to inscribe a first circle that has a radius in the cross sectional view corresponding to a radius of a second, envelope circle of the power cable having a maximum radius inside the steel pipe, but excluding thicknesses of the binder and the jacket, and wherein the three ground buses have outer diameters such that the three ground buses project in a radial direction from the center, outwardly of an envelope closed curve of the three transmission cables surrounding the outer peripheral surfaces of the three transmission cables in the cross sectional view, but the outer diameters of the three ground buses are less than or equal to a diameter of the first circle.

2. The power cable as claimed in claim 1, wherein the three ground buses have the outer diameters such that the outer peripheral surfaces of the three ground buses inscribe the first circle.

3. The power cable as claimed in claim 1, wherein both ends of each of the three ground buses are electrically connected to a potential node equal to a potential of the reference potential node.

4. The power cable as claimed in claim 2, wherein both ends of each of the three ground buses are electrically connected to a potential node equal to a potential of the reference potential node.

5. The power cable as claimed in claim 1, wherein the three transmission cables in the cross sectional view maintain the 3-fold rotationally symmetrical positions with respect to the center through which a virtual center line passes, while being twisted around the virtual center line.

6. The power cable as claimed in claim 5, wherein the three ground buses in the cross sectional view maintain the 3-fold rotationally symmetrical positions with respect to the center, while being twisted around the three transmission cables.

7. The power cable as claimed in claim 2, wherein the three transmission cables in the cross sectional view maintain the 3-fold rotationally symmetrical positions with respect to the center through which a virtual center line passes, while being twisted around the virtual center line.

8. The power cable as claimed in claim 7, wherein the three ground buses in the cross sectional view maintain the 3-fold rotationally symmetrical positions with respect to the center, while being twisted around the three transmission cables.

9. The power cable as claimed in claim 3, wherein the three transmission cables in the cross sectional view maintain the 3-fold rotationally symmetrical positions with respect to the center through which a virtual center line passes, while being twisted around the virtual center line.

10. The power cable as claimed in claim 9, wherein the three ground buses in the cross sectional view maintain the 3-fold rotationally symmetrical positions with respect to the center, while being twisted around the three transmission cables.

11. The power cable as claimed in claim 4, wherein the three transmission cables in the cross sectional view maintain the 3-fold rotationally symmetrical positions with respect to the center through which a virtual center line passes, while being twisted around the virtual center line.

12. The power cable as claimed in claim 11, wherein the three ground buses in the cross sectional view maintain the 3-fold rotationally symmetrical positions with respect to the center, while being twisted around the three transmission cables.

13. The power cable as claimed in claim 1, wherein each of the three ground buses is made up of a plurality of wires that are twisted to form a single wire.

14. The power cable as claimed in claim 1, wherein each of the three ground buses is a bare conductor wire.

15. The power cable as claimed in claim 1, further comprising:

a resin member made of an insulator and filling gaps between the three transmission cables and the three ground buses, inside of the binder.

16. The power cable as claimed in claim 1, further comprising:

a resin member made of an insulator and filling gaps between the three transmission cables and the three ground buses, inside of the binder, wherein the resin member is in direct contact with the outer peripheral surfaces of the three transmission cables, the outer peripheral surfaces of the three ground buses, and an inner peripheral surface of the binder.

17. The power cable as claimed in claim 1, wherein the three transmission cables respectively further include a conductor screen provided between the one of the three conductor wires and the insulating layer.

18. The power cable as claimed in claim 1, wherein the three transmission cables respectively further include an insulator screen provided between the insulating layer and the semiconductive layer.

19. The power cable as claimed in claim 1, wherein the three transmission cables respectively further include a conductor screen provided between the one of the three conductor wires and the insulating layer, and an insulator screen provided between the insulating layer and the semiconductive layer.

* * * * *